US010151464B2

(12) United States Patent
Ahern

(10) Patent No.: US 10,151,464 B2
(45) Date of Patent: Dec. 11, 2018

(54) USER-ACTUATED LIGHTING EFFECT DEVICE

(71) Applicant: Michael John Ahern, El Granada, CA (US)

(72) Inventor: Michael John Ahern, El Granada, CA (US)

( * ) Notice: Subject to any disclaimer, the term of this patent is extended or adjusted under 35 U.S.C. 154(b) by 0 days.

(21) Appl. No.: 15/585,718

(22) Filed: May 3, 2017

(65) Prior Publication Data

US 2017/0234518 A1 Aug. 17, 2017

Related U.S. Application Data

(63) Continuation-in-part of application No. 29/545,324, filed on Nov. 11, 2015, now Pat. No. Des. 789,896.

(51) Int. Cl.

| | |
|---|---|
| ***F21S 6/00*** | (2006.01) |
| ***F21V 23/04*** | (2006.01) |
| ***F21W 131/406*** | (2006.01) |
| ***F21V 21/30*** | (2006.01) |

(52) U.S. Cl.

CPC ..... *F21V 21/30* (2013.01); *F21S 6/00* (2013.01); *F21V 23/04* (2013.01); *F21W 2131/406* (2013.01)

(58) Field of Classification Search

CPC . F21V 21/30; F21V 23/04; F21S 6/00; F21W 2131/406

See application file for complete search history.

(56) References Cited

U.S. PATENT DOCUMENTS

| | | | |
|---|---|---|---|
| 3,017,497 | A | 1/1962 | Albright |
| 3,818,214 | A | 6/1974 | Jackson et al. |
| D236,212 | S | 8/1975 | Beigel et al. |
| D244,214 | S | 5/1977 | Ross et al. |
| 4,121,488 | A | 10/1978 | Akiyama |
| 4,167,783 | A | 9/1979 | Mitchell |
| 4,319,311 | A | 3/1982 | Mitchell |
| 5,347,431 | A | 9/1994 | Blackwell et al. |
| 5,702,172 | A | 12/1997 | Kilburn |

(Continued)

FOREIGN PATENT DOCUMENTS

FR 2645770 A1 10/1990

OTHER PUBLICATIONS

American DJ Group of Companies Home Page Forum; forums.americandj.com; first post of Nov. 11, 2003, 9:37 p.m.; 2 pgs.

(Continued)

*Primary Examiner* — Donald Raleigh

(74) *Attorney, Agent, or Firm* — Haynes Beffel & Wolfeld LLP; Ernest Beffel; Andrew Dunlap

(57) ABSTRACT

A user-actuated lighting effect device, to provide a lighting effect for a performer during a performance, includes lower and upper portions. The lower portion has an upper surface with a plurality of devices thereat. The upper portion has a first surface. The upper portion is placeable in (1) a closed state with the first surface directly overlying the upper surface, and (2) an open state with the first surface being in an upwardly facing orientation not overlying the upper surface to provide overhead access to the plurality of devices. The upper portion can be pivotally mounted to the lower portion for movement between the open and closed states.

6 Claims, 4 Drawing Sheets

(56) References Cited

U.S. PATENT DOCUMENTS

| | | | | |
|---|---|---|---|---|
| 5,800,048 | A * | 9/1998 | Gordin | F21V 7/0016 362/275 |
| 5,803,590 | A * | 9/1998 | Wedell | F21S 8/086 362/263 |
| 5,894,686 | A | 4/1999 | Parker et al. | |
| 6,215,055 | B1 | 4/2001 | Saravis | |
| 6,267,240 | B1 * | 7/2001 | Callaway | B25H 3/02 206/373 |
| 6,659,620 | B2 * | 12/2003 | Goto | A47B 97/00 362/11 |
| 6,905,222 | B1 * | 6/2005 | Russello | F21S 8/033 362/147 |
| D518,086 | S | 3/2006 | Ito | |
| 7,150,542 | B1 * | 12/2006 | Russello | F21S 8/033 362/285 |
| 7,461,957 | B2 | 12/2008 | Thompson et al. | |
| 7,563,972 | B2 | 7/2009 | Kubitz et al. | |
| 7,824,052 | B1 | 11/2010 | Halm | |
| D682,346 | S | 5/2013 | Bogdan et al. | |
| 8,483,404 | B2 | 7/2013 | Bogdan et al. | |
| 8,802,961 | B2 | 8/2014 | Juszkiewicz | |
| D735,146 | S | 7/2015 | Sawada | |
| 9,185,776 | B2 | 11/2015 | Ahem | |
| 9,462,654 | B2 | 10/2016 | Ahem | |
| 9,533,804 | B2 * | 1/2017 | Shlonsky | B65D 51/245 |
| 2003/0066410 | A1 | 4/2003 | Stratton | |
| 2004/0250673 | A1 | 12/2004 | Salerno | |
| 2005/0091884 | A1 | 5/2005 | Omstead et al. | |
| 2006/0032364 | A1 | 2/2006 | Ludwig | |
| 2007/0206375 | A1 | 9/2007 | Piepgras et al. | |
| 2007/0223239 | A1 | 9/2007 | Thompson et al. | |
| 2007/0281811 | A1 | 12/2007 | Wang | |
| 2011/0008536 | A1 | 1/2011 | Oh | |
| 2011/0088536 | A1 | 4/2011 | McMillen et al. | |
| 2011/0095874 | A1 | 4/2011 | Bennett | |
| 2011/0249425 | A1 | 10/2011 | Aurongzeb et al. | |
| 2013/0233156 | A1 | 9/2013 | Kapp et al. | |
| 2014/0077723 | A1 * | 3/2014 | Ahern | H05B 33/0863 315/299 |
| 2014/0090546 | A1 | 4/2014 | Ceccolini et al. | |
| 2014/0205113 | A1 | 7/2014 | Slipp et al. | |
| 2014/0226331 | A1 * | 8/2014 | Kinnune | F21V 29/74 362/249.02 |
| 2014/0301101 | A1 | 10/2014 | Russ | |
| 2015/0161973 | A1 | 6/2015 | Packouz | |
| 2015/0267902 | A1 * | 9/2015 | Zhang | F21L 4/04 362/188 |
| 2016/0209015 | A1 * | 7/2016 | Mumma | F21V 21/30 |
| 2016/0275928 | A1 | 9/2016 | Lee | |
| 2018/0058809 | A1 * | 3/2018 | Moore | F41C 33/029 |

OTHER PUBLICATIONS

MBT Lighting SCX101 16 Channel DMX Lighting Foot Controller; User Manual; in existance as of Nov. 25, 2011; 21 pgs.

The Gear Page—Strobe Lights Controlled Via Foot Switch; www.thegearpage.net; Jan. 26, 2009, 8:34 p.m.; 1 pg.

U.S. Appl. No. 29/545,324—Notice of Allowance dated Feb. 17, 2017, 13 pages.

U.S. Appl. No. 14/919,676—Office Action dated Apr. 21, 2016, 14 pages.

U.S. Appl. No. 14/919,676—Response to Office Action dated Apr. 21, 2016, filed May 17, 2016, 10 pages.

U.S. Appl. No. 14/919,676—Notice of Allowance dated Jun. 6, 2016, 10 pages.

U.S. Appl. No. 14/030,927—Notice of Allowance dated Sep. 28, 2015, 9 pages.

U.S. Appl. No. 14/030,927—Final Office Action dated Jul. 31, 2015, 11 pages.

U.S. Appl. No. 14/030,927—Response to Final Office Action dated Jul. 31, 2015, filed Aug. 14, 2015, 10 pages.

U.S. Appl. No. 14/030,927—Nonfinal Office Action dated Jan. 21, 2015, 15 pages.

U.S. Appl. No. 14/030,927—Response to Nonfinal Office Action dated Mar. 6, 2015, 13 pages.

* cited by examiner

USER-ACTUATED LIGHTING EFFECT DEVICE

CROSS-REFERENCE TO OTHER APPLICATIONS

This application is a continuation in part of U.S. patent application Ser. No. 29/545,324, filed 11 Nov. 2015, the disclosure of which is incorporated by reference as if fully set forth herein.

This application is related to (1) U.S. patent application Ser. No. 14/030,927 filed on 18 Sep. 2013, now U.S. Pat. No. 9,185,776, issued on 10 Nov. 2015, which claims the benefit of U.S. Provisional Patent Application No. 61/702,628 filed on 18 Sep. 2012; and (2) U.S. patent application Ser. No. 14/919,676 filed on 21 Oct. 2015, now U.S. Pat. No. 9,462,654 issued on 4 Oct. 2016; these applications are incorporated by reference as if fully set forth herein.

BACKGROUND OF THE INVENTION

This invention relates to lighting effect devices.

BRIEF SUMMARY OF THE INVENTION

A user-actuated lighting effect device, to provide a lighting effect for a performer during a performance, includes lower and upper portions. The lower portion has an upper surface with a plurality of devices thereat. The upper portion has a first surface. The upper portion is placeable in (1) a closed state with the first surface directly overlying the upper surface, and (2) an open state with the first surface being in an upwardly facing orientation not overlying the upper surface to provide overhead access to the plurality of devices.

Examples of the user-actuated lighting effect device can include one or more the following. The upper portion can be pivotally mounted to the lower portion for movement between the open and closed states. A component can be mounted to the first surface. The plurality of devices can include first and second types of devices. The lower portion can have side walls on opposite sides thereof, and the upper portion can have side panels extending parallel to but laterally outwardly of the side walls when device is in the closed state; the side walls can have lower edges and the side panels can extend past the lower edges when device is in the closed state.

Other features, aspects and advantages of the present invention can be seen on review the drawings, the detailed description, and the claims which follow.

DETAILED DESCRIPTION OF THE INVENTION

Figure 1:
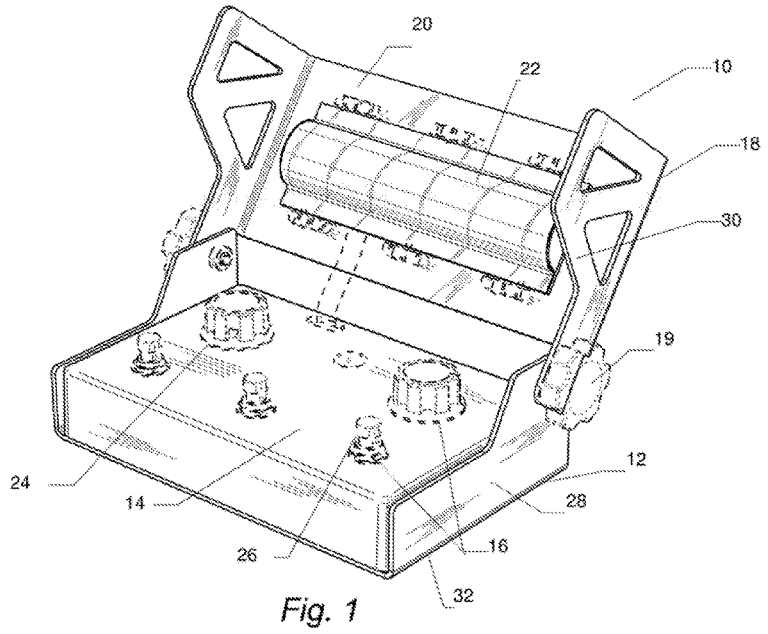
FIG. 1 is a front, right side, top view of a User-Actuated Lighting Effect Device in an open state, with the upper portion pivoted upwardly from the lower portion, showing my new design.
Figure 2:
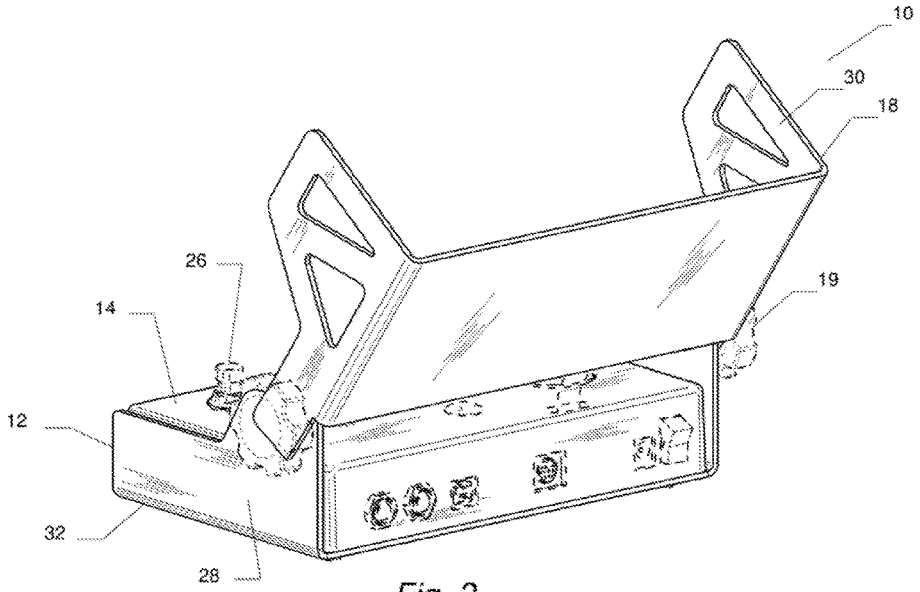
FIG. 2 is a rear, right side, top view thereof.
Figure 3:
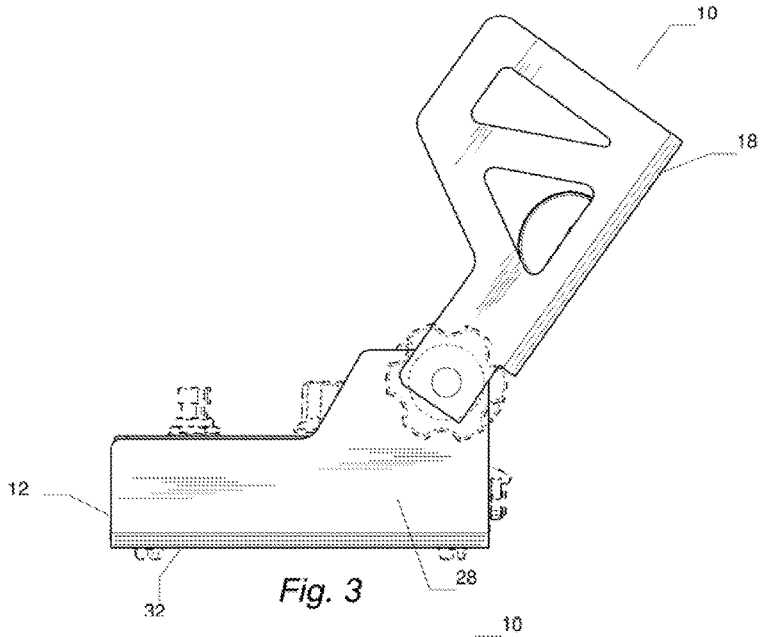
FIG. 3 is a right side elevation view thereof.
Figure 4:
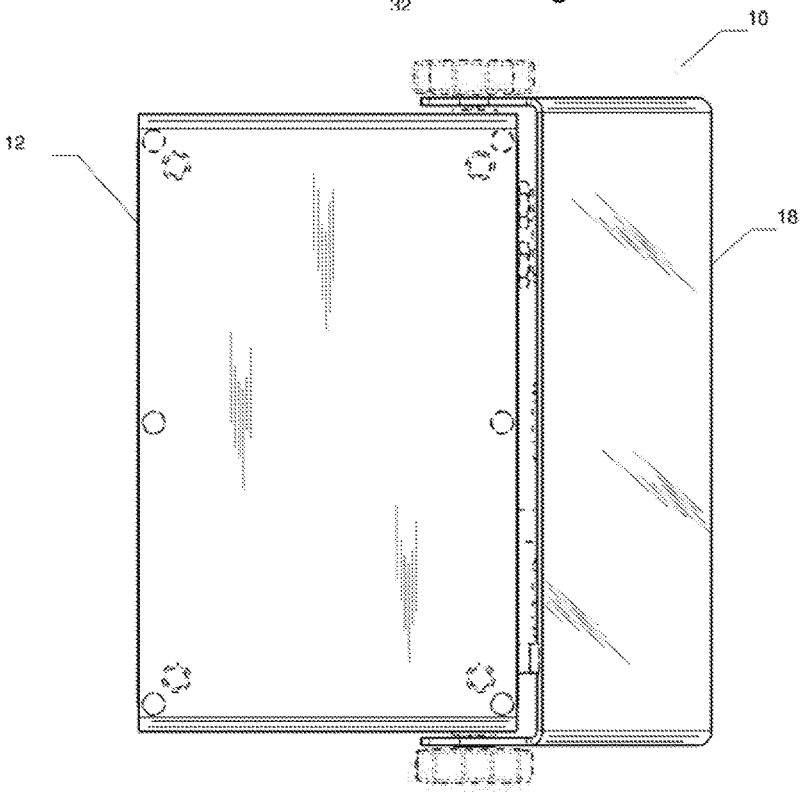
FIG. 4 is a bottom plan view thereof.
Figure 5:
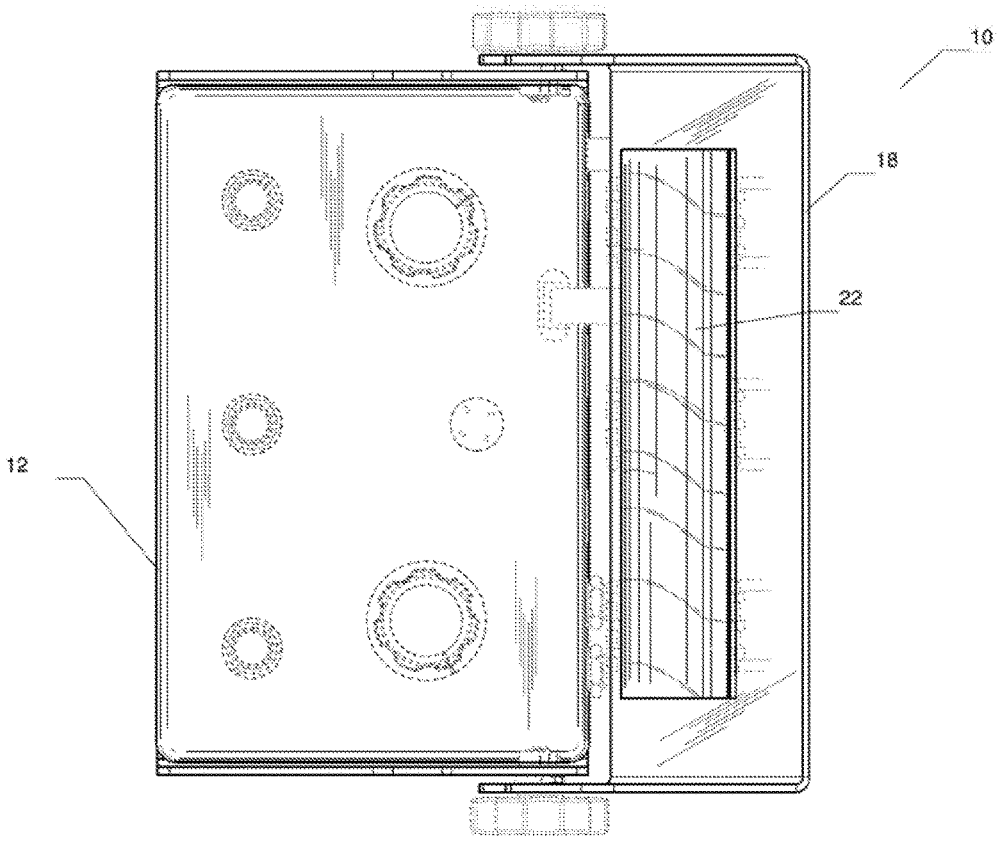
FIG. 5 is a top plan view thereof.
Figure 6:
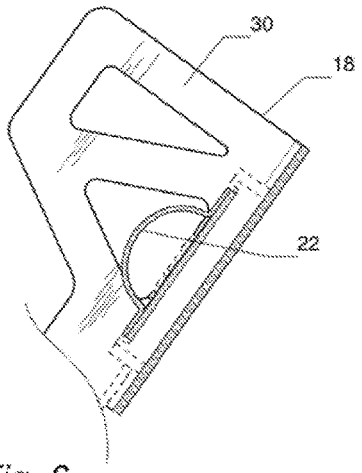
FIG. 6 is a cross-sectional view of a part of the upper portion.

The following description will typically be with reference to specific structural embodiments and methods. It is to be understood that there is no intention to limit the invention to the specifically disclosed embodiments and methods but that the invention may be practiced using other features, elements, methods and embodiments. Preferred embodiments are described to illustrate the present invention, not to limit its scope, which is defined by the claims. Those of ordinary skill in the art will recognize a variety of equivalent variations on the description that follows. Unless otherwise stated, in this application specified relationships, such as parallel to, aligned with, or in the same plane as, mean that the specified relationships are within limitations of manufacturing processes and within manufacturing variations. When components are described as being coupled, connected, being in contact or contacting one another, they need not be physically directly touching one another unless specifically described as such. Like elements in various embodiments are commonly referred to with like reference numerals.

Figure 7:
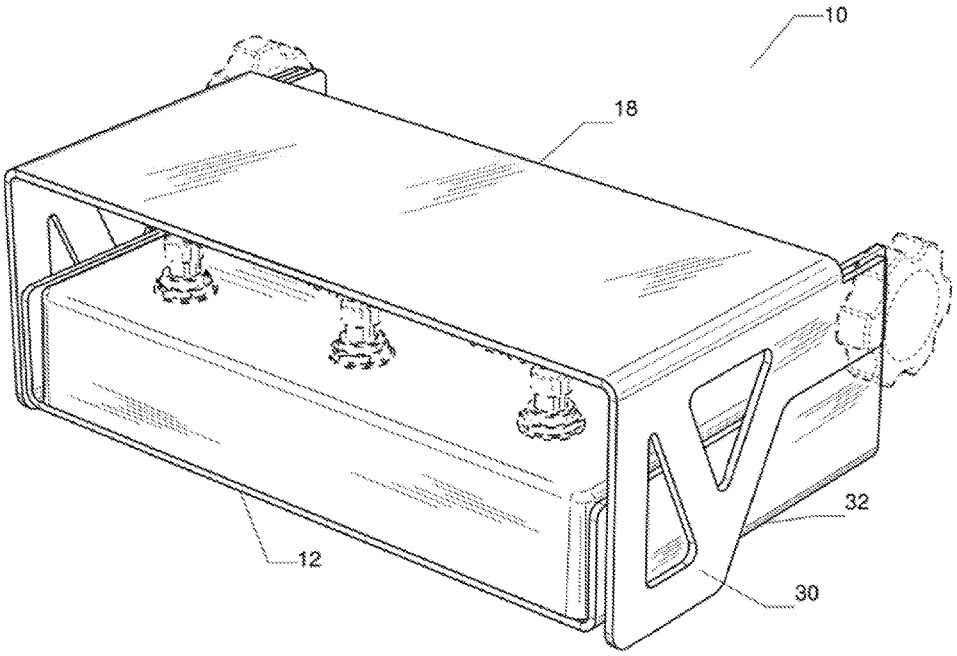
FIG. 7 is a front, right side, top view thereof in a closed state with the upper portion pivoted downwardly onto the lower portion.
Figure 8:
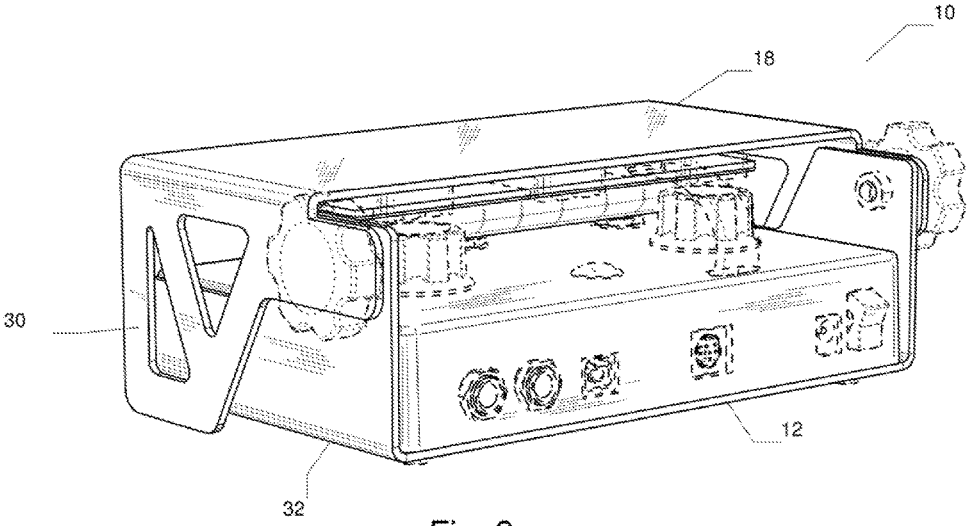
FIG. 8 is a rear, right side, top view thereof in the closed state.

FIGS. 1-8 illustrate a user-actuated lighting effect device 10 to provide a lighting effect for a performer during a performance. FIGS. 1-6 illustrate device 10 in an open state while FIGS. 7 and 8 illustrate device 10 in a closed state. Device 10 includes a lower portion 12 having an upper surface 14 with a plurality of devices 16 thereon. Device 10 also includes an upper portion 18 pivotally mounted to the lower portion 12 by pivot mounting elements 19. The upper portion 18 has a first surface 20.

The upper portion 18 is placeable in (1) a closed state, see FIGS. 7-8, with the first surface 20 directly overlying the upper surface 14, and (2) an open state, see FIGS. 1-6, with the first surface 20 being in an upwardly facing orientation not overlying the upper surface 14 to expose the plurality of devices 16. The plurality of devices 16 includes first and second types of devices as is shown in FIGS. 1-5, the first type of device 16 comprises a rotary type device 24 and the second type of device comprises a pushbutton type device 26. When in the open state, in some examples, rotary type device 24 can be operated by hand while pushbutton type device 26 can be actuated by a user's foot.

An elongate, domed component 22 is mounted to the first surface 20. See FIGS. 1 and 6. As indicated by transparent material shade lines, the component 22 comprises a transparent material so that a lighting effect can pass through the component 22 of transparent material. A lighting effect for a performer during a performance can be created by light from a lamp located between component 22 and first surface 20.

The lower portion 12 has side walls 28 on opposite sides thereof. The upper portion 18 has side panels 30 extending parallel to but laterally outwardly of the side walls 28 when device 10 is in the closed state. The side walls 28 have lower edges 32. Side panels 30 extend past the lower edges 32 when device 10 is in the closed state. See FIGS. 7 and 8.

While the present invention is disclosed by reference to the preferred embodiments and examples detailed above, it is to be understood that these examples are intended in an illustrative rather than in a limiting sense. It is contemplated that modifications and combinations will occur to those skilled in the art, which modifications and combinations will be within the spirit of the invention and the scope of the following claims.

The following clauses describe aspects of various examples of the technology disclosed. Reference numerals are used for convenient reference to corresponding components in disclosed examples.

1. A user-actuated lighting effect device 10 to provide a lighting effect for a performer during a performance, comprising:

a lower portion 12 having an upper surface 14 with a plurality of devices 16 thereat;

an upper portion 18 having a first surface 20, the upper portion placeable in (1) a closed state (FIGS. 7-8) with the first surface directly overlying the upper surface, and (2) an open state (FIGS. 1-6) with the first surface being in an upwardly facing orientation not overlying the upper surface to provide overhead access to the plurality of devices.

2. The user-actuated lighting effect device according to clause 1, wherein the upper portion is pivotally mounted 19 to the lower portion for movement between the open and closed states.

3. The user-actuated lighting effect device according to clause 1, further comprising a component 22 mounted to the first surface 20.

4. The user-actuated lighting effect device according to clause 3, wherein the component 22 comprises a transparent material.

5. The user-actuated lighting effect device according to clause 4, wherein a lighting effect can pass through the component 22 of transparent material.

6. User-actuated lighting effect device according to clause 5, wherein the component 22 of transparent material comprises an elongate, domed component 22 of transparent material.

7. The user-actuated lighting effect device according to clause 1, wherein the plurality of devices comprises first and second types of devices.

8. The user-actuated lighting effect device according to clause 7, wherein the first type of device comprises a rotary type of device 24.

9. The user-actuated lighting effect device according to clause 7, wherein the second type of device comprises a pushbutton type of device 26.

10. The user-actuated lighting effect device according to clause 1, wherein:

the lower portion 12 has side walls 28 on opposite sides thereof; and the upper portion 18 has side panels 30 extending parallel to but laterally outwardly of the side walls 28 when device 10 is in the closed state.

11. The user-actuated lighting effect device according to clause 10, wherein the side walls 28 have lower edges 32 and the side panels 30 extend past the lower edges when device 10 is in the closed state.

12. A user-actuated lighting effect device 10 to provide a lighting effect for a performer during a performance, comprising:

a lower portion 12 having an upper surface 14 with a plurality of devices 16 thereat;

an upper portion 18 pivotally mounted 19 to the lower portion;

the upper portion 18 having a first surface 20, the upper portion placeable in (1) a closed state (FIGS. 7-8) with the first surface directly overlying the upper surface, and (2) an open state (FIGS. 1-6) with the first surface being in an upwardly facing orientation not overlying the upper surface to provide overhead access to the plurality of devices;

a component 22 mounted to the first surface 20;

the lower portion 12 having side walls 28 on opposite sides thereof;

the upper portion 18 having side panels 30 extending parallel to but laterally outwardly of the side walls 28 when device 10 is in the closed state; and the side walls 28 have lower edges 32 and the side panels 30 extend past the lower edges when device 10 is in the closed state.

13. The user-actuated lighting effect device according to clause 12, wherein the component 22 comprises a transparent material, wherein a lighting effect can pass through the component 22 of transparent material.

14. The user-actuated lighting effect device according to clause 1, wherein the plurality of devices 16 comprises first and second types of devices, the first type of device comprises a rotary type of device 24 and the second type of device comprises a pushbutton type of device 26.

Any and all patents, patent applications and printed publications referred to above are incorporated by reference.

What is claimed is:

1. A user-actuated lighting effect device to provide a lighting effect for the user, comprising:

a lower portion having an upper surface with a plurality of devices thereat, including at least one foot actuated switch;

an upper portion having a first surface, the upper portion placeable in (1) a closed state with the first surface directly overlying the upper surface, and (2) an open state with the first surface being in an upwardly facing orientation not overlying the upper surface to provide overhead access to the plurality of devices; and a lighting effect component mounted to the first surface that projects light onto the user.

2. The user-actuated lighting effect device according to claim 1, wherein the upper portion is pivotally mounted to the lower portion for movement between the open and closed states.

3. The user-actuated lighting effect device according to claim 1, wherein the plurality of devices comprises first and second types of devices.

4. The user-actuated lighting effect device according to claim 1, further including a plurality of the foot actuated switches.

5. A user-actuated lighting effect device to provide a lighting effect for the user, comprising:

a lower portion having an upper surface with a plurality of devices thereat, including at least one foot actuated switch;

an upper portion having a first surface, the upper portion placeable in (1) a closed state with the first surface directly overlying the upper surface, and (2) an open state with the first surface being in an upwardly facing orientation not overlying the upper surface to provide overhead access to the plurality of devices, wherein:

the lower portion has side walls on opposite sides thereof, the upper portion has side panels extending parallel to but laterally outwardly of the side walls when device is in the closed state, and the side walls have lower edges and the side panels extend past the lower edges when device is in the closed state.

6. A user-actuated lighting effect device to provide a lighting effect for a performer during a performance, comprising:

a lower portion having an upper surface with a plurality of devices thereat;

an upper portion pivotally mounted to the lower portion;

the upper portion having a first surface, the upper portion placeable in (1) a closed state with the first surface directly overlying the upper surface, and (2) an open state with the first surface being in an upwardly facing orientation not overlying the upper surface to provide overhead access to the plurality of devices;

a component mounted to the first surface;

the lower portion having side walls on opposite sides thereof;

the upper portion having side panels extending parallel to but laterally outwardly of the side walls when device is in the closed state; and the side walls have lower edges and the side panels extend past the lower edges when device is in the closed state.

* * * * *